US006608547B1

(12) United States Patent
Greier et al.

(10) Patent No.: US 6,608,547 B1
(45) Date of Patent: Aug. 19, 2003

(54) LOW CAPACITY MULTILAYER VARISTOR

(75) Inventors: Guenther Greier, Graz-St. Peter (AT); Heinrich Zoedl, Deutschlandsberg (AT); Guenter Engel, Leibnitz (AT); Reinhard Sperlich, Kolbermoor (DE)

(73) Assignee: Epcos AG, Munich (DE)

( * ) Notice: Subject to any disclaimer, the term of this patent is extended or adjusted under 35 U.S.C. 154(b) by 55 days.

(21) Appl. No.: 10/019,523

(22) PCT Filed: Jul. 6, 2000

(86) PCT No.: PCT/DE00/02204

§ 371 (c)(1),
(2), (4) Date: Dec. 27, 2001

(87) PCT Pub. No.: WO01/03148

PCT Pub. Date: Jan. 11, 2001

(30) Foreign Application Priority Data

Jul. 6, 1999 (DE) ..... 199 31 056

(51) Int. Cl.[7] ..... H01C 7/10
(52) U.S. Cl. ..... 338/21; 338/20
(58) Field of Search ..... 338/20, 21

(56) References Cited

U.S. PATENT DOCUMENTS

| | | | | | |
|---|---|---|---|---|---|
| 3,857,174 | A | | 12/1974 | May | |
| 4,460,623 | A | | 7/1984 | Levinson | |
| 4,675,644 | A | | 6/1987 | Ott et al. | |
| 5,245,309 | A | | 9/1993 | Kawase et al. | |
| 6,008,717 | A | * | 12/1999 | Kawase et al. | 338/22 R |
| 6,087,923 | A | * | 7/2000 | Ahn et al. | 338/21 |
| 6,147,587 | A | * | 11/2000 | Hadano et al. | 338/21 |
| 6,184,769 | B1 | * | 2/2001 | Nakamura et al. | 338/21 |
| 6,260,258 | B1 | * | 7/2001 | Tokunaga et al. | 29/612 |
| 6,346,871 | B1 | * | 2/2002 | Ogasawara et al. | 338/21 |

FOREIGN PATENT DOCUMENTS

| | | | | |
|---|---|---|---|---|
| DE | 42 07 915 | | 9/1992 | |
| DE | 43 34 059 | | 4/1995 | |
| DE | 196 34 498 | | 1/1999 | |
| EP | 0 821 374 | | 1/1998 | |
| JP | 1-66907 | * | 3/1989 | 338/21 |
| JP | 10163008 | | 6/1998 | |

* cited by examiner

*Primary Examiner*—Karl D. Easthom
(74) *Attorney, Agent, or Firm*—Schiff Hardin & Waite

(57) ABSTRACT

The invention is directed to a low-capacitance multi-layer varistor having a ceramic body and two terminals that are applied on the ceramic body spaced from one another. The ceramic body is constructed in film technology with multi-layer structure and preferably comprises inner electrodes whose ends lie opposite one another with a gap.

5 Claims, 2 Drawing Sheets

LOW CAPACITY MULTILAYER VARISTOR

BACKGROUND OF THE INVENTION

1. Field of the Invention

The present invention is directed to a low-capacitance (i.e.,<10 pF) multi-layer varistor having a ceramic body and two terminals that are applied on the ceramic body at a distance from one another.

2. Description of the Related Art

Up to now, spark gaps that, for example, can be realized by two tips of an interconnect lying opposite one another, have preferably been utilized for the electrostatic or electrostatic discharge (ESD) protection of high-frequency circuits and data lines. When an impermissibly high voltage occurs for a high-frequency circuit or data line to be protected, the spark gap between the two tips of the interconnect lying opposite one another ignites, carrying an arcing discharge, so that this impermissibly high voltage is not adjacent at the high-frequency circuit or data line.

The ignition of the spark gap occurs according to specific physical laws in which the gas discharge characteristic is specifically traversed. This event requires a specific time duration so that the time alone that is needed for the ionization of the spark gap is usually longer than the rise time of an ESD pulse, which can lie on the order of magnitude of 700 ps.

In summary, this means that, due to their inertia, spark gaps have disadvantages when used as ESD protection of high-frequency circuits or data lines.

Compared to spark gaps, multi-layer varistors are characterized by a substantially shorter response time: the response time of multi-layer varistors are on the order or magnitude of 500 ps, which is lower by approximately a factor of 2 than the response time of spark gaps. Nonetheless, multi-layer varistors have previously not been utilized as ESD protection of high-frequency circuits or data lines, because of the laminar structure of the multi-layer varistors. This laminar structure, namely, leads to parasitic capacitances that make the use of multi-layer varistors impossible in high-frequency circuits with frequencies above 100 MHz. Such high-frequency circuits are, for example, high-frequency input circuits such as antenna inputs, etc.

FIGS. 13 through 15 show an existing multi-layer varistor in perspective (see FIG. 13), in section (see FIG. 14) or in an overall view with inner electrodes conducted out (see FIG. 15).

Given this multi-layer varistor, a ceramic body 1 is provided with terminals 8 at two opposite sides, these overlapping in the ceramic body 1 spaced from one another. Active zones 9 are formed in the overlap regions, and insulation zones 11 are provided outside the overlap regions 9.

FIG. 15 shows an element of the multi-layer varistor of FIG. 14: a layer of the ceramic body 1 is placed between two inner electrodes 7 that respectively form metallized surfaces 12 on this layer.

Such existing multi-layer varistors are poorly suited as ESD protection of high-frequency circuits and data lines because of their capacitance. In a given ceramic material having a defined dielectric constant E, this capacitance is determined by the area of the inner electrodes 7 or of the terminals 8, by the number of layers of the ceramic body 1 between the inner electrodes 7, i.e., by the number of active zones 9, and the thicknesses of the ceramic layers or active zones deriving as a result of the desired operating voltage.

Up to now, multi-layer varistors manufactured in such a technology have had capacitances on the order of magnitude of at least 30 through 50 pF, which precludes the use of such multi-layer varistors for the ESD protection of, for example, sensitive antenna inputs despite their low response time.

SUMMARY OF THE INVENTION

It is therefore an object of the present invention to create a multi-layer varistor that is distinguished by such a low capacitance that it can be employed without further effort for ESD protection in high-frequency circuits such as, in particular, antenna inputs.

This object is inventively achieved (in a low-capacitance multi-layer varistor having a ceramic body and two terminals that are applied on the ceramic body at a distance from one another) in that the ceramic body is built up using a film technique with a multi-layer structure. Expediently, the ceramic body is provided with inner electrodes that proceed comb-like from the two terminals so that the ends of the electrodes lie opposite one another with a gap (or spacing) in the direction between the terminals.

Given the inventive multi-layer varistor, the inner electrodes are, in particular, arranged comb-like, so that the electrodes of the two terminals no longer overlap but have their ends lying opposite one another. The low capacitance of the multi-layer varistor is thus determined via the spacing of these ends of the electrodes lying opposite one another (the "gap"). Given a constant or nearly constant gap, the capacitance can be reduced further by a serial arrangement of the gaps. In the limiting case, the varistor voltage can even be increased further and the capacitance reduced when inner electrodes are completely foregone. The influence of the terminals or outside termination on the varistor voltage and on the capacitance that is present in this limiting case can be eliminated by applying an additional passivation layer so that the maximum varistor voltage for a given volume can be achieved given minimal capacitance in such an exemplary embodiment.

The inner electrodes can be designed with different electrode lengths. It is also possible to shape the tips of the inner electrodes differently from one another.

Due to the non-overlapping inner electrodes, the electrode spacing can be considerably enlarged in the inventive multi-layer varistor, which correspondingly reduces the capacitance. As a result of the inner electrodes lying opposite one another, the direction of the current flow in the inventive multi-layer varistor is also modified compared to the existing multi-layer varistor, thus enabling a drastic increase in the varistor voltage.

Experiments by the inventors have shown that the curve of the current density can be positively influenced in the inventive multi-layer varistor due to the indicated arrangement of the inner electrodes. It is thus possible to manufacture a multi-layer varistor with a non-linear voltage/current characteristic that is high-impedance at voltages of, for example, 300 V and above.

DESCRIPTION OF THE DRAWINGS

The invention is explained in greater detail below on the basis of the drawings, in which component parts that correspond to one another have been provided with the same reference characters.

DETAILED DESCRIPTION OF THE INVENTION

Figure 1:
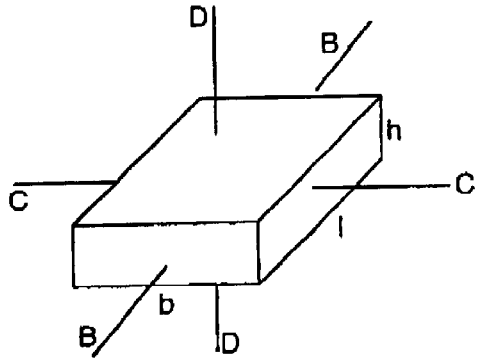
FIG. 1 is a schematic illustration of a multi-layer varistors in perspective for defining the respective directions.

FIG. 1 schematically shows a multi-layer varistor with a ceramic body having a length 1, a breadth b and a height h, in which a current flows in a direction BB between two terminals (not shown). A direction CC or DD proceeds perpendicular to the direction BB.

FIGS. 2 through 8 show schematic sections BB of various exemplary embodiments of the inventive multi-layer varistor, whereas FIGS. 9 through 12 show schematic sections DD of the inventive multi-layer varistor with different electrode tips. These different electrode tips can be specifically applied in a multilayer varistor according to the exemplary embodiments of FIGS. 2 and 8. However, it is also possible to provide such different electrode tips in the exemplary embodiments of FIGS. 3 through 5.

The inventive multi-layer varistor is distinguished by a multi-layer structure in film technique, in which different layers with and without inner electrodes are placed above one another and form the ceramic body 1, on whose two ends in the direction BB (see FIG. 1) metallic terminals 2, 3 of aluminum or of other materials as well are applied. The application of the terminals 2, 3 can, for example, take place using vapor deposition.

Figure 2:
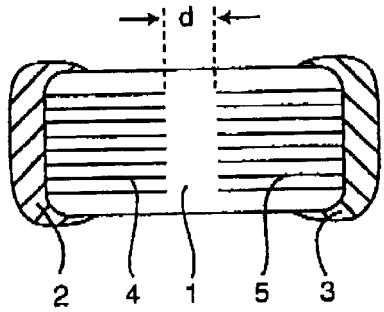
FIG. 2 is a sectional view of an inventive multi-layer varistor with a comb-like inner electrode arrangement.
Figure 3:
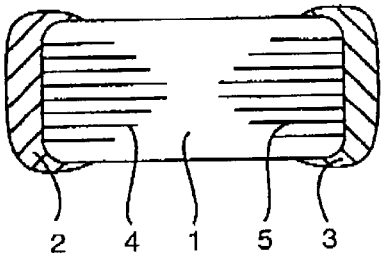
FIG. 3 is a sectional view of an inventive multi-layer varistor with a comb-like inner electrode arrangement with different electrode lengths.

FIG. 2 shows a first exemplary embodiment of the inventive multi-layer varistor with inner electrodes 4, 5 in a ceramic body 1. The inner electrodes 4 are connected to the terminal 2, whereas the inner electrodes 5 are connected with the terminal 3. The ends of the inner electrodes 4 are provided at a spacing or "gap" d from the ends of the inner electrodes 5. The inner electrodes 4, 5 are respectively arranged in a comb-like manner so that the inner electrodes of the two terminals 4, 5 lie opposite one another at the distance d. The low capacitance of the multi-layer varistor is determined by this spacing or gap d.

As a result of this low capacitance, the inventive multi-layer varistor is suited without further modifications as an ESD protection of, for example, sensitive antenna inputs in SMD (surface mounted device) structures.

Given the exemplary embodiment of FIG. 2, the inner electrodes 4, 5 respectively are the same length, but this is not required. On the contrary, it is possible to design the inner electrodes 4, 5 with different lengths, as provided in the exemplary embodiment of FIG. 3. Here, the inner electrodes placed in the middle of the ceramic body 1 have a greater length than inner electrodes at the edge of the ceramic body 1.

Figure 4:
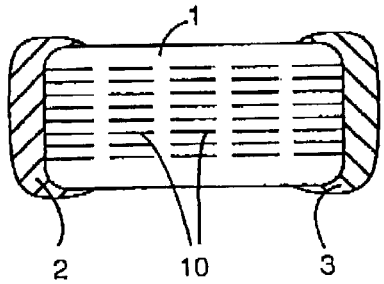
FIG. 4 is a sectional view of an inventive multi-layer varistor with a comb-like inner electrode arrangement having a serial implementation of gaps.

Given a constant length of the gap d, the capacitance of the multi-layer varistor can be reduced further by serial arrangement of these gaps, as shown in the exemplary embodiment of FIG. 4. In this embodiment, the individual gaps between inner electrodes 10 likewise have the length d; however, the inner electrodes 10 are repeatedly interrupted in the inside of the ceramic body 1, so that only those electrodes 10 that are adjacent to the terminals 2, 3 are connected to the latter, whereas the other inner electrodes are electrically separated from these terminals and other inner electrodes, as shown in FIG. 4. A total of four gaps between the inner electrodes 10 are provided in the exemplary embodiment of FIG. 4. This need not necessarily be the case: on the contrary, it is also possible to potentially provide more than four or fewer than four gaps between the individual rows of inner electrodes 10.

Figure 5:
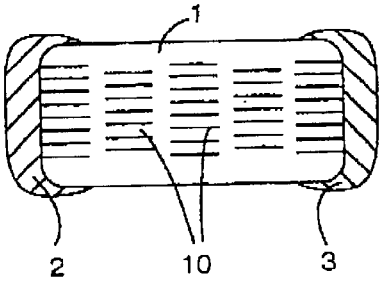
FIG. 5 is a sectional view of an inventive multi-layer varistor with a comb-like inner electrode arrangement having a serial implementation of gaps and offset of the inner electrodes relative to one another.

FIG. 5 shows a further exemplary embodiment of the inventive multi-layer varistor that is the same as the exemplary embodiment of FIG. 4 insofar as a plurality of rows of inner electrodes 10 likewise form a total of four gaps here. Differing from the exemplary embodiment of FIG. 4, however, the inner electrodes 10 are arranged at an offset relative to one another in the exemplary embodiment of FIG. 5. i.e., the inner electrodes 10 of different rows lie at a different level in the direction DD. A further reduction of the capacitance can be achieved by such a design of the inner electrodes 10.

Figure 6:
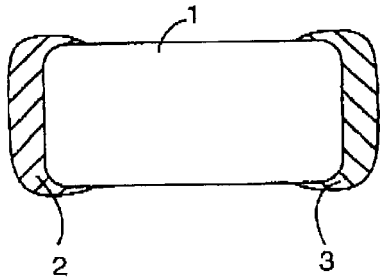
FIG. 6 is a sectional view of an inventive multi-layer varistor without inner electrodes.
Figure 7:
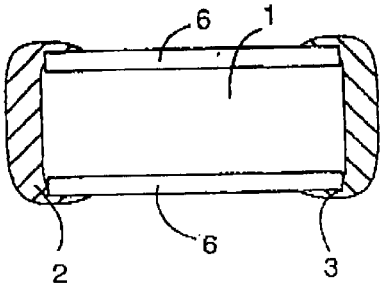
FIG. 7 is a sectional view of an inventive multi-layer varistor without inner electrodes having a passivation layer applied on the ceramic body.

In the limiting case, the varistor voltage can be increased further and the capacitance of the multi-layer varistor reduced by eliminating the inner electrodes, as shown in the exemplary embodiment of FIG. 6 where only the terminals 2, 3 on the ceramic body 1 are applied in a multi-layer structure. The influence of the outside termination by the terminals 2, 3 on the varistor voltage and the capacitance of the multi-layer varistor that is present given such a structure can be eliminated by applying an additional passivation layer 6, as shown in the exemplary embodiment of FIG. 7. With reference to a unit volume, a maximum varistor voltage given a minimum capacitance can be achieved as a result of such a design.

An important feature of the invention is the increase of the electrode spacing by foregoing inner electrodes or by employing non-overlapping inner electrodes. A significant increase of the varistor voltage with a given volume can be achieved due to the modification of the current flow in the ceramic body brought about as a result. Moreover, the capacitance given this volume is also greatly diminished, so that capacitance values below 10 pF can be achieved.

Figure 8:
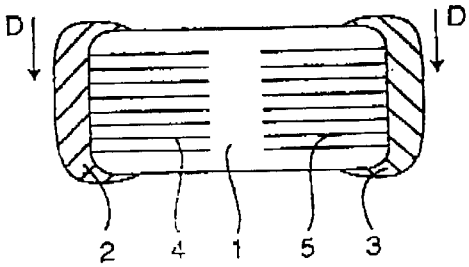
FIG. 8 is a multi-layer varistor similar to the exemplary embodiment of FIG. 2 having straight electrode tips.
Figure 9:
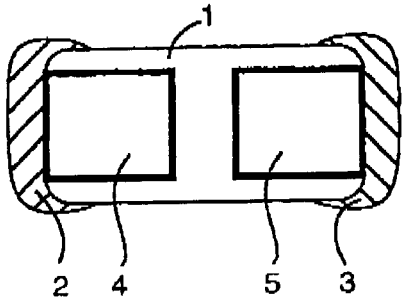
FIG. 9 is a section DD through the multi-layer varistor of FIG. 8.
Figure 10:
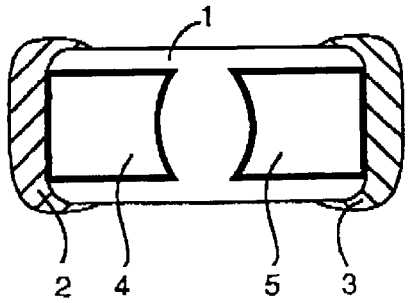
FIG. 10 is a section DD through an inventive multi-layer varistor with concave electrode tips.
Figure 11:
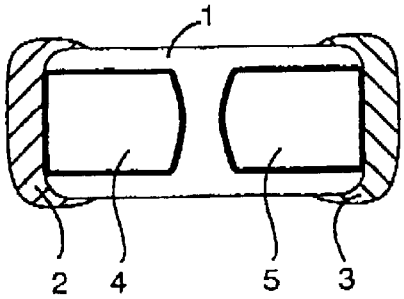
FIG. 11 is a section DD through an inventive multi-layer varistor with convex electrode tips.
Figure 12:
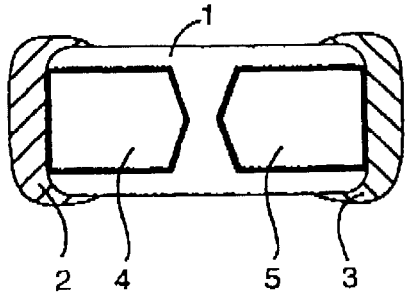
FIG. 12 is a section DD through the inventive multi-layer varistor with pointed electrode tips.
Figure 13:
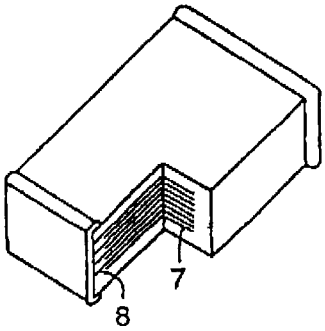
Fig. 13 PRIOR ART
FIGS. 13–15 are illustrations for explaining a known multi-layer varistor (explained in the Background section).
Figure 14:
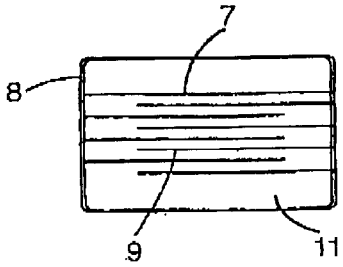
Fig. 14 PRIOR ART
Figure 15:
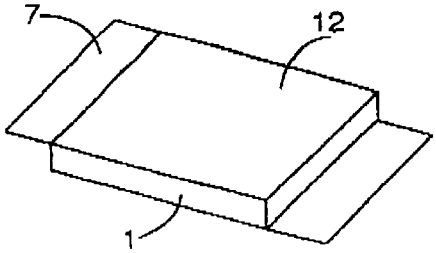
Fig. 15 PRIOR ART

The inner electrode tips can be designed differently, as shown in the exemplary embodiments of FIGS. 9 through 12 showing sections in the plane EC or plan views from the direction DD (see FIG. 1) specifically onto the multi-layer varistors of FIGS. 2 and 8: FIG. 8 shows an exemplary embodiment that is the same as the exemplary embodiment of FIG. 2 insofar as inner electrodes of the same length are provided. This, however, need not necessarily be the case. On the contrary, it is also possible to provide inner electrodes of different length in the exemplary embodiment of FIG. 8, as is the case given the exemplary embodiment of FIG. 3.

It is then possible to provide straight electrode tips (see FIG. 9), concave electrode tips (see FIG. 10), convex electrode tips (see FIG. 11) or "pointed" electrode tips (see FIG. 12) for the inner electrodes 4, 5. As warranted, these different designs of the electrode tips can also be employed in the exemplary embodiments of FIGS. 4 and 5, so that the inner electrodes 10 here are designed in a way similar to the inner electrodes 4, 5. The invention is not limited to these specific shapes that are discussed above by way of example, but include any suitable shape for this application.

Given the inventive multi-layer varistor, the curve of the current density between the two terminals 2, 3 can be favorably influenced by the arrangement of the inner electrodes, so that, as a result of the multi-layer structure brought about by the film technique, a component having non-linear voltage/current characteristic can be manufactured that is high-impedance given voltage of approximately 300 V.

The above-described varistor is illustrative of the principles of the present invention. Numerous modifications and adaptations will be readily apparent to those skilled in this art without departing from the spirit and scope of the present invention.

What is claimed is:

1. A multi-layer varistor, comprising:

a ceramic body that is constructed in film technology;

two terminals that are applied on the ceramic body at a specified distance from one another;

inner electrodes that proceed comb-like from the two terminals, so that ends of the inner electrodes lie opposite one another with a spacing in a direction between the two terminals, the inner electrodes proceeding from one terminal do not overlap inner electrodes proceeding from the other terminal, at least one electrode of the inner electrodes in a layer being repeatedly interrupted so that only those parts of the at least one electrode that are adjacent to the terminals are connected to the terminals, and at least one other part of the at least one electrode is electrically separated from these terminals, the at least one electrode comprising a plurality of gaps in a serial arrangement.

2. A multi-layer varistor according to claim 1, wherein the inner electrodes are designed with different electrode lengths.

3. A multi-layer varistor according to claim 1, wherein tips of the inner electrodes have shapes selected from the group consisting of straight, concave, convex, and pointed.

4. A multi-layer varistor according to claim 1, further comprising:

a passivation layer on the ceramic body.

5. A multi-layer varistor according to claim 1, wherein parts of the inner electrodes not connected to the terminals are arranged at an offset relative to those parts of the inner electrodes connected to the terminals, the parts of the inner electrodes arranged at an offset configured to not overlap parts of the inner electrodes connected to the terminals.

* * * * *